United States Patent [19]

Mori et al.

[11] Patent Number: 4,842,753

[45] Date of Patent: Jun. 27, 1989

[54] SILICONE GREASE COMPOSITION

[75] Inventors: Shigeru Mori; Toshikazu Sugita, both of Annaka, Japan

[73] Assignee: Shin-Etsu Chemical Co., Ltd., Tokyo, Japan

[21] Appl. No.: 188,328

[22] Filed: May 4, 1988

[30] Foreign Application Priority Data

May 7, 1987 [JP] Japan ..... 62-111506

[51] Int. Cl.[4] ..... C10M 105/08

[52] U.S. Cl. ..... 252/42.7; 252/49.6

[58] Field of Search ..... 252/42.7, 49.6

[56] References Cited

U.S. PATENT DOCUMENTS

| | | | |
|---|---|---|---|
| 3,352,781 | 11/1967 | Buehler | 252/42.7 |
| 3,356,702 | 12/1967 | Farmer et al. | 252/42.7 |
| 3,462,367 | 8/1969 | Booher | 252/42.7 |
| 3,840,463 | 10/1974 | Froeschmann et al. | 252/42.7 |
| 4,369,119 | 1/1983 | de Vries et al. | 252/42.7 |
| 4,431,553 | 2/1984 | Fodor et al. | 252/42.7 |
| 4,549,004 | 10/1985 | von Au et al. | 252/42.7 |
| 4,759,863 | 7/1988 | Mori et al. | 252/49.6 |
| 4,772,409 | 9/1988 | Mori et al. | 252/49.6 |

*Primary Examiner*—William R. Dixon, Jr.
*Assistant Examiner*—Margaret B. Medley
*Attorney, Agent, or Firm*—Millen & White

[57] ABSTRACT

A silicone grease composition composed of an organopolysiloxane fluid and a thickneing agent is admixed with from 0.5 to 20% by weight of a copper dialkyl dithiocarbamate or, in particular copper diethyl dithiocarbamate as a lubrication improving agent so that the grease composition is imparted with greatly improved boundary lubrication under extreme-pressure conditions between steel and steel as well as improved thermal stability.

6 Claims, No Drawings

SILICONE GREASE COMPOSITION

BACKGROUND OF THE INVENTION

The present invention relates to a silicone grease composition or, more particularly, to a silicone grease composition having greatly improved lubrication performance relative to the extreme pressure lubrication between steel and steel, which is the most serious problem in conventional silicone grease compositions to be used for lubrication bearings of various machines and the like.

It is well known that silicones, i.e. organopolysiloxane products, in general have excellent properties such as the very small temperature dependency of viscosity, shearing characteristics, chemical stability against heat and oxidation and so on as compared with ordinary organic materials. Silicone grease compositions prepared from a silicone fluid as the base oil are also excellent in these regards. One of the serious problems in the silicone grease compositions is that, in comparison to most of mineral oil-based and synthetic lubricating oil-based grease compositions, silicone grease compositions are generally poor in the performance of boundary lubrication, especially, between steel and steel so that satisfactory lubrication is not obtained under conditions of extereme pressure at high velocity and under high load, which greatly limits the applicability of silicone greases in the lubrication of most of heavy-duty machines.

In this connection, various proposals and attempts have been hitherto made to improve the lubricating performance of silicone greases, mainly, by admixing the silicone grease with various kinds of special additives. The additives proposed so far include fatty acids and derivatives thereof as an oiliness improver and organic compounds of halogen, phosphorus and sulfur as an extreme pressure additive to improve boundary lubrication. It is known that a great improvement can be obtained in the capacity of a silicone grease to withstand a heavy load by admixing the silicone grease with a salt of a dialkyl dithiocarbamic acid with a metal or metalloid element such as zinc, lead, antimony and the like as an extreme pressure additive. Additives of this type are not fully satisfactory in silicone grease compositions since the consistency of the silicone grease admixed with such an additive is increased within a relatively short time when the grease is exposed of time an they or used at high temperatures over a period to eventually lose their grease-like consistency and become resinous.

U.S. Pat. No. 3,642,646 teaches addition of an antimony salt to a silicone grease prepared from a fluorine-containing organopolysiloxane fluid as the base oil. Although a great improvement can be obtained by this means in the capacity of the grease to withstand heavy loads, such a silicone grease composition is defective due to the decrease in the thermal stability thereof at a high temperature of, for example, 250° C. or higher.

SUMMARY OF THE INVENTION

The present invention accordingly has an object to provide a novel and improved silcone grease composition free from the above described problems and disadvantages associated with the prior art silicone grease compositions. The silicone grease composition of the invention comprises, in admixture:

(a) 100 parts by weight of an organopolysiloxane fluid having a viscosity in the range from 20 to 100,000 centistokes at 25° C. and represented by the average unit formula $$R^1_nSiO_{(4-n)/2)}, \quad (I)$$

in which $R^1$ is an optionally substituted monovalent hydrocarbon group having 1 to 21 carbon atoms and the subscript n is a positive number in the range from 1.2 to 2.2;

(b) from 10 to 90 parts by weight of a thickening agent; and (c) a copy dialkyl dithiocarbamate represented by the general formula $$(R_2N—CS—S)_2Cu, \quad (II)$$

in which R is an alkyl group having 1 to 10 carbon atoms, in an amount effective to substantially improve the boundary lubrication of the silicone grease composition composed of the components (a) and (b).

The amount of the component (c) is, for example, in the range from 0.5 to 20% by weight based on the overall amount of the components (a) and (b).

DETAILED DESCRIPTION OF THE PREFERRED EMBODIMENTS

As is described above, the essential ingredients in the inventive silicone grease composition are the components (a), (b), and (c), of which the component (c) is the most characteristic, the components (a) and (b) being rather conventional. This component is particularly effective as an extreme pressure additive in silicone grease compositions to greatly improve the boundary lubrication between steel and steel without affecting the thermal stability of the silicone grease due to the absence of any thermal decomposition product accelerating thermal degradation of the organopolysiloxane fluid as the base oil of the grease or rather exhibiting an activity to prevent thermal oxidation of the organopolysiloxane fluid. Accordingly, the inventive silicone grease composition has much higher heat resistance than those with admixture of a dialkyl dithiocarbamate of zinc, lead or antimony with greatly decreased thermal degradation at high temperatures. Furthermore, the silicone grease composition of the invention is never solidified or converted into a resinous mass even when it is kept prolongedly at high temperatures. Therefore, the inventive silicone grease composition is capable of giving excellent lubrication at high speeds and under heavy loads to greatly extend the serviceable life of the machine lubricated therewith and decrease the costs for the maintenance of the machine.

The base oil in the inventive silicone grease composition, viz component (a), is an organopolysiloxane fluid represented by the average unit formula (I) given above. In the formula, $R^1$ is a monovalent hydrocarbon group having 1 to 21 carbon atoms exemplified by alkyl groups, e.g., methyl, ethyl, propyl and butyl groups, cycloalkyl groups, e.g., cyclohexyl group, and aryl groups, e.g., phenyl and tolyl groups, as well as those substituted monovalent hydrocarbon groups obtained by replacing a part or all of the hydrogen atoms in the above named hydrocarbon groups with substituent atoms and/or groups such as halogen atoms, cyano groups and the like exemplified by chloromethyl, 3,3,3-trifluoropropyl and 2-cyanoethyl groups. The groups denoted by $R^1$ in the organopolysiloxane is not limited to a single kind of the above named groups. In this regard, a preferable organopolysiloxane fluid contains 3,3,3-trifluoropropyl groups in an amount of 10 to 50% by moles or, more preferably, 20 to 50% by moles based on the overall number of the groups denoted by $R^1$ in a molecule in respect of the performance of lubrication. Phenyl groups are also preferable as the groups denoted by $R^1$ in a molar proportion of 5 to 50% based on the overall amount of the groups denoted by $R^1$. An organopolysiloxane fluid whose molar content of phenyl groups is 5 to 10% is preferable in respect of the low pour point as the base oil in silicone grease compositions for low-temperature use. An organopolysiloxane fluid whose molar content of phenyl groups is 20 to 50% is preferable with respect to the high thermal stability as the base oil with silicone grease compositions for high-temperature use. The subscript n in the average unit formula is a positive number with the range from 1.2 to 2.2. The organopolysiloxane fluid preferably has a viscosity in the range from 20 to 100,000 centistokes at 25° C.

Like conventional silicone grease compositions, the above described organopolysiloxane fluid is compounded with a thickening agent in order to be imparted with grease-like consistency. Examples of suitable thickening agents include metal soaps, e.g., salts of fatty acid with lithium or a metal other than alkali metals and terephthalamic acid salts of metals, carbon blacks, finely divided silica powders, bentonite after an organophilic treatment, certain urea derivatives and finely divided poly(tetrafluoroethylene) resins. The thickening agent is compounded with the organopolysiloxane fluid in an amount in the range from 10 to 90 parts by weight per 100 parts by weight of the fluid although the exact amount thereof should be adequately selected depending on the desired consistency of the grease composition.

The silicone grease composition obtained by compounding the above desired organopolysiloxane fluid and the thickening agent is further admixed with a specific additive, viz component (c), which is a copper dialkyl dithiocarbamate represented by the general formula $(R_2N—CS—S)_2Cu$, in which R is an alkyl group having 1 to 10 carbon atoms or, preferably, 2 to 5 carbon atoms or, more preferably, 2 to 4 carbon atoms, exemplified by copper diethyl dithiocarbamate, copper dipropyl dithiocarbamate and copper dibutyl dithiocarbamate. The amount of this specific additive in the inventive silicone grease composition is in the range from 0.5 to 20% by weight or, preferably, from 1 to 10% by weight based on the overall amount of the components (a) and (b). When the amount of the additive is too small, insufficient improvement can be obtained in the lubricating performance of the grease composition. Increasing the amount of the additive over the above mentioned upper limit is economically disadvantageous due to the expensiveness of the additive compound since no further improvement can be obtained by increasing the amount beyond that range.

The essential ingredients in the inventive silicone grease composition are the above described components (a), (b) and (c) and the grease composition can be prepared by adding the component (c) to the base grease composition prepared by compounding the components (a) and (b). It is of course optional that the inventive silicone grease composition is further admixed with various kinds of known additives conventionally used in silicone grease compositions including antioxidants such as phenolic compounds, amino compounds and metal oxides, oiliness improvers such as fatty acids or derivatives thereof, rust inhibitors such as metal sulfonates, inorganic and organic coloring agents and the like, though each in a limited amount.

In the following, the silicone grease composition of the invention is described in more detail by way of examples, in which the term of "parts" always refers to "parts by weight" and the values of viscosity are all those obtained by measurement at 25° C.

EXAMPLE 1

A silicone grease composition, which is referred to as the Grease I hereinbelow, was prepared by compounding 63 parts of a methyl 3,3,3-trifluoropropyl polysiloxane fluid having a viscosity of 150 centistokes, in which 28% by moles of all of the organic groups bonded to the silicon atoms were 3,3,3-trifluoropropyl groups, with 37 parts of a fine powder of a poly(tetrafluoroethylene) resin together with 5 parts of copper diethyl dithiocarbamate.

For comparison, four further silicone grease compositions, which are referred to as the Greases, II, III, IV and V hereinbelow, were prepared with the same formulation as in the Grease I except for the omission of the copper diethyl dithiocarbamate in the Grease II and the replacement of the copper diethyl dithiocarbamate with the same amount of antimony, zinc and iron diethyl dithiocarbamate in the Greases III, IV and V, respectively.

Each of these Greases I to V was subjected to the four-ball test using ½-inch steel balls at room temperature for 60 minutes under a load of 40 kg and a velocity of rotation of 1200 rpm to determine the diameter of the wear marks on the steel balls. Further, these greases were subjected to the heat stability test by heating at 250° C. for 500 hours under an atmosphere of open air in a brass-made cup of 19 mm inner diameter and 11 mm depth to determine the weight decrease and changes in the consistency or appearance all of the greases excepting Grease I had become solidified whereas Grease I retained its grease-like consistency unchanged. Table 1 below shows the results for the diameter of the wear marks on the steel balls in the four-ball test and the amount of weight loss in the heat stability test.

TABLE 1

| | Grease No. | | | | |
|---|---|---|---|---|---|
| | I | II | III | IV | V |
| Diameter of wear marks, mm | 1.26 | 2.77 | 1.31 | 1.24 | 1.32 |
| Weight loss, % | 27.0 | 31.5 | 38.0 | 56.7 | 37.9 |

EXAMPLE 2

Four silicone grease compositions, referred to as the Greases VI, VII, VIII and IX hereinbelow, were prepared, each with the same formulation as in the Grease I prepared in Example 1 except that the amount of copper diethyl dithiocarbamate was decreased or increased to 1,3,7 and 10 parts, respectively.

Each of these greases as well as the Grease I was subjected to the four-ball test under the same testing conditions as in Example 1 to determine the diameter of the wear marks on the steel balls after 60 minutes of testing time. The results for the Greases VI, VII, I, VIII and IX were 1.98 mm, 1.58 mm, 1.26 mm, 1.18 mm and 0.92 mm. respectively, thereof showing the effectiveness of the additive as a lubrication improving agent at the various concentrations.

EXAMPLE 3

A silicone grease composition, referred to as the Grease X hereinbelow, was prepared by compounding 80 parts of a methyl phenyl organopolysiloxane fluid having a viscosity of 450 centistokes, in which 25% by moles and 75% by moles of the organic groups bonded to the silicon atoms were phenyl groups and methyl groups, respectively, with 20 parts of lithium stearate and 5 parts of copper diethyl dithiocarbamate. For comparison, another silicone grease composition, referred to as the Grease XI hereinbelow, was prepared in the same formulation as above excepting omission of the copper diethyl dithiocarbamate.

Each of these greases was subjected to the four-ball test under the same testing conditions as in Example 1 to find that the diameters of the wear marks of the steel balls were 1.36 mm and 1.89 mm with the Greases X and XI, respectively.

What is claimed is:

1. A silicone grease composition which comprises, in admixture:

(a) 100 parts by weight of an organopolysiloxane fluid having a viscosity in the range from 200 to 100,000 centistokes at 25° C. and represented by the average unit formula $$R^1_nSiO_{(4-n)/2},$$

in which $R^1$ is an optionally substituted monovalent hydrocarbon group having 1 to 21 carbon atoms and the subscript n is a positive number in the range from 1.2 to 2.2;

(b) from 10 to 90 parts by weight of a thickening agent; and (c) a copper dialkyl dithiocarbamate represented by the general formula $$(R_2N—CS—S)_2Cu,$$

in which R is an alkyl group having 1 to 10 carbon atoms, in an amount from 0.5 to 20% to substantially improve the boundary lubrication of the silicone grease composition composed of the components (a) and (b).

2. The silicone grease composition as claimed in claim 1 wherein the alkyl group denoted by R has 2 to 4 carbon atoms.

3. The silicone grease composition as claimed in claim 2 wherein the alkyl group denoted by R is an ethyl group.

4. The silicone grease composition as claimed in claim 1 wherein the amount of component (c) is in the range from 1 to 10% by weight based on the overall amount of components (a) and (b).

5. The silicone grease composition as claimed in claim 1 wherein from 10 to 50 mol. % of the $R^1$ groups are 3,3,3-trifluoropropyl groups and the rest of the $R^1$ groups are methyl groups.

6. The silicone grease composition as claimed in claim 1 wherein from 5 to 50 mol. % of the $R^1$ groups are phenyl groups and the rest of the $R^1$ groups are methyl groups.

* * * * *